United States Patent [19]

Simanjuntak

[11] Patent Number: 4,889,451

[45] **Date of Patent: * Dec. 26, 1989**

[54] DRIVEN PILE WITH TRANSVERSE BROADENING IN SITU

[76] Inventor: Johan H. Simanjuntak, Jalan Tanah Abang II/23, Jakarta, Indonesia

[ * ] Notice: The portion of the term of this patent subsequent to Mar. 29, 2005 has been disclaimed.

[21] Appl. No.: 114,115

[22] Filed: Oct. 27, 1987

Related U.S. Application Data

[63] Continuation of Ser. No. 934,620, Nov. 24, 1986, Pat. No. 4,733,994, which is a continuation of Ser. No. 698,103, Feb. 4, 1985, abandoned.

[51] Int. Cl.[4] ..... E02D 5/74

[52] U.S. Cl. ..... 405/244; 405/232

[58] Field of Search ..... 405/244, 232, 253, 224, 405/237, 240; 52/159, 329, 160, 98; 411/21; 175/5–7

[56] References Cited

U.S. PATENT DOCUMENTS

| | | | |
|---|---|---|---|
| 1,026,402 | 5/1912 | Marshall et al. | 52/159 |
| 1,762,341 | 6/1930 | McPherson | 405/244 X |
| 2,198,964 | 4/1940 | Goodyear | 403/12 |
| 2,299,814 | 10/1942 | Gale et al. | 411/21 X |
| 2,468,729 | 5/1949 | Black | 405/244 X |
| 2,812,200 | 11/1957 | Yeargan | 403/12 |
| 2,878,649 | 3/1959 | Jacobs | 175/9 X |
| 2,881,591 | 4/1959 | Reeve | 405/224 |
| 3,312,138 | 4/1967 | Cumming | 411/21 |
| 3,526,069 | 1/1970 | Deike | 52/160 |
| 3,628,337 | 12/1971 | Stepanich | 405/253 |
| 4,091,882 | 5/1978 | Hashimoto | 52/160 X |

FOREIGN PATENT DOCUMENTS

| | | | |
|---|---|---|---|
| 97525 | 1/1984 | European Pat. Off. | 405/244 |
| 0157033 | 10/1985 | European Pat. Off. | 405/244 |
| 2405238 | 8/1975 | Fed. Rep. of Germany | 52/159 |
| 0142925 | 11/1981 | Japan | 405/244 |
| 761663 | 9/1980 | U.S.S.R. | 405/244 |
| 815125 | 3/1981 | U.S.S.R. | 405/244 |
| 525548 | 8/1940 | United Kingdom . | |
| 1009399 | 11/1965 | United Kingdom | 411/21 |
| 1315609 | 5/1973 | United Kingdom . | |

*Primary Examiner*—Dennis L. Taylor
*Attorney, Agent, or Firm*—Christie, Parker & Hale

[57] ABSTRACT

A pile assembly for supporting a structure after being driven into a soil stratum comprises a pile body having a hollow interior. Two or more slots extend through the pile body. A steel plate is retained within each slot by returning bars. When driven into the ground, a mandrel is inserted into the pile body and used to push downwardly an inverted pyramidally shaped actuator which, in turn, forces the steel plates outwardly into the soil stratum, deforming the retainer bars which exert an upward pressure on the plates to maintain the plates against the upper edge of the slot.

6 Claims, 4 Drawing Sheets

Fig. 5
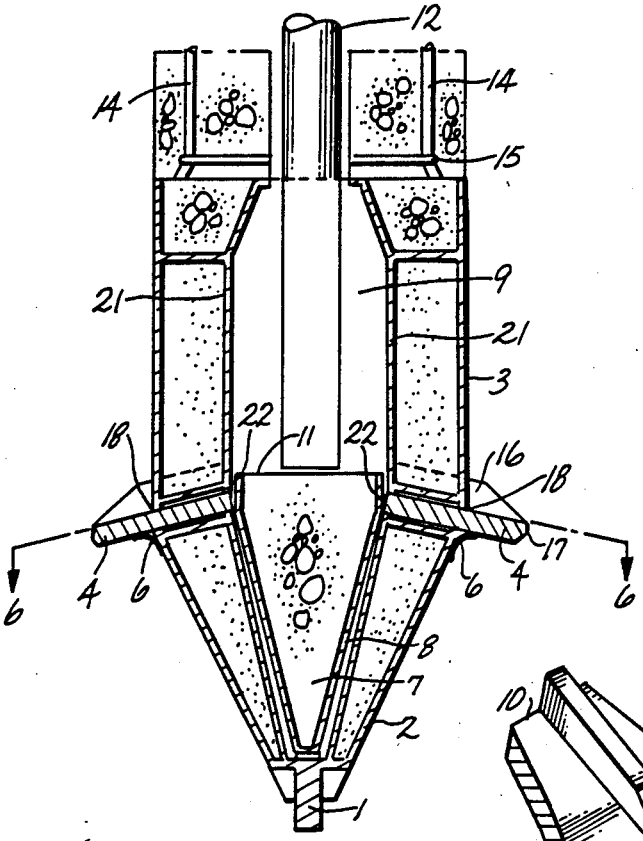
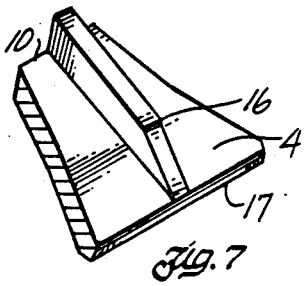
Fig. 7
Fig. 6
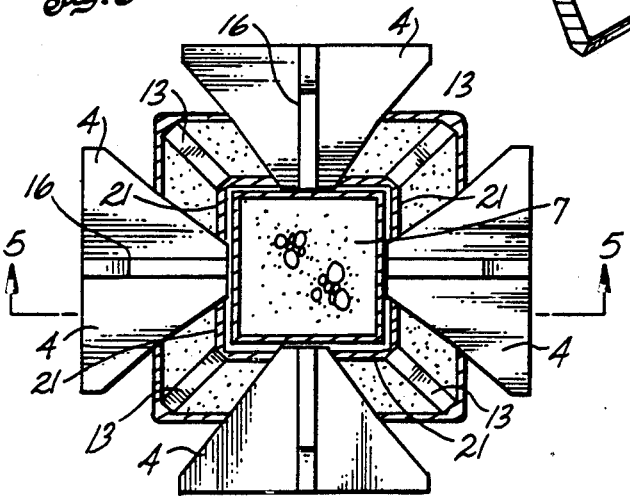

DRIVEN PILE WITH TRANSVERSE BROADENING IN SITU

This application is a continuation of application Ser. No. 06/934,620, filed Nov. 24, 1986, now U.S. Pat. No. 4,733,994, which is a continuation of Ser. No. 698,103, filed Feb. 4,1985, now abandoned.

BACKGROUND OF THE INVENTION

1. Field of the Invention

This invention relates to piles, which may be square or round in cross-section, made of pre-case concrete or steel.

2. Description of Related Art

It is well understood that the overall bearing capacity of a pile is determined by two factors viz, the bearing capacity of the soil in the area in which the pile is to be driven and the structural strength of the pile itself. Generally, of these two limitations, the bearing capacity of soil is a decisive factor. The problem now is how to increase the total soil bearing capacity relative to the pile or to improve the interactions between the soil layers and the pile body to such an extent that the total bearing capacity becomes higher. The bearing capacity of the soil relative to the pile depends on two forces; these are the friction forces acting against the body of the pile and the end bearing forces.

The broader the pile foot, the greater the end resistance of the pile itself. However, a pre-cast concrete pile with an enlarged foot cannot be easily driven, due to the greater resistance in penetrating the soil layer.

SUMMARY OF THE INVENTION

According to the present invention, there is provided a pile formed of pre-cast concrete or of steel or other suitable metal. The pile is provided at least at one part along its length with an assembly of substantially transversely extending steel or other suitable metal plates. During driving of the pile, the plates are located wholly within the pile but can be caused to protrude from the sides of the pile upon completion of driving of the pile to increase or improve the bearing capacity of the pile. When the pile tip reaches the firm soil strata, driving is discontinued. The cross-sectional area of the pile foot or toe, or another part of the pile, is then increased, preferably, horizontally, in such a way that the pile will have a wider contact base, which increases the soil bearing capacity of the pile.

When this invention is applied to the toe of a pile, it has three functions, each of which positively complement one another to increase the quality and performance of the pile. Firstly, the invention reinforces the pile tip for penetrating hard layers. Secondly, pre-cast concrete pile tips produced manually on site in wooden molds are often asymmetric in form, and the resulting pile has a tendency to deviate from its original path during driving. Using the present invention, the pile can be driven in a straight direction without deviation. A steel pile toe manufactured according to the present invention with precision in a standard form substantially eliminates any deviation.

The third and major function of the toe of the present invention is to provide a broader base for the pile, which increases the bearing capacity of the pile as a whole.

According to an embodiment of the invention, steel discs or plates are located inside the lower part of the pile body, preferably exactly at the line between the vertical surface of the pile and the tapered surface of the pile tip. However, the steel plates can be placed either at the lower part of the pile or anywhere along the pile body.

The toe is preferably made of steel. The steel plates are preferably located inside and placed horizontally within the toe. The steel plates can be pushed out through apertures and penetrate into the soil horizontally after driving of the pile is complete.

The plates are pushed out immediately after driving is completed, when the pile tip has reached and arrived at the firm soil layer. The plates are pushed out from the center of the toe by friction forces produced at the inner side of the plates from the downward motion of a conical or pyramid-shaped actuator member in the center of the pile. However, a part of the steel plates remains inside the apertures.

During assembly of the pile and toe, and during transportation and driving of the pile, the steel plates should always be retained wholly inside the body. Small steel bars or steel plates placed across the outer ends of the apertures prevent the plates from sliding out. The lower end of each bar or steel plate is welded to the outer surface of the pile foot.

BRIEF DESCRIPTION OF THE DRAWINGS

An embodiment of the invention will now be described, by way of an example, with reference to the accompanying drawings, in which:

FIG. 5 is a longitudinal section through the toe of the pile of FIG. 2 with the plates moved outwardly, the section being taken along the line V-V of FIG. 6;

FIG. 6 is a transverse section through the toe of the pile of FIG. 2 taken along the line VI-VI of FIG. 5;

FIG. 7 is a perspective view of a steel plate for use in the embodiments of FIGS. 1–6.

DETAILED DESCRIPTION OF THE PREFERRED EMBODIMENT

Figure 1:
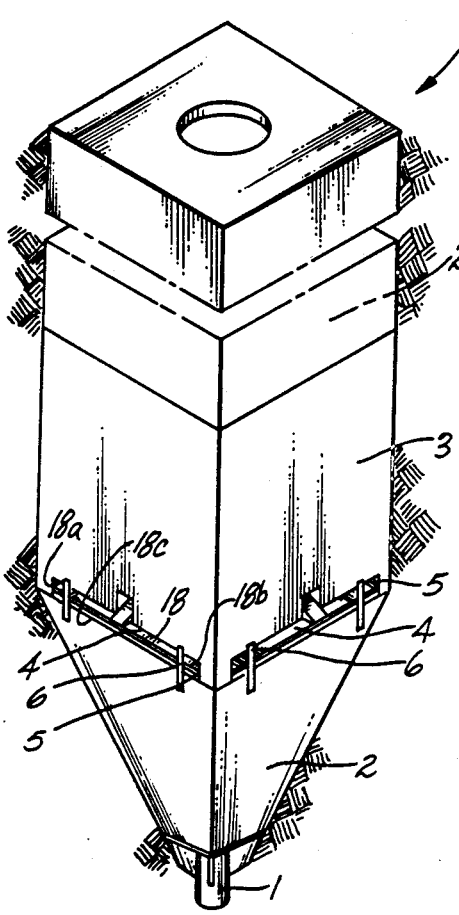
FIG. 1 is a perspective view of a pile according to the present invention in a form to be used during driving with plates in a retracted position.
Figure 2:
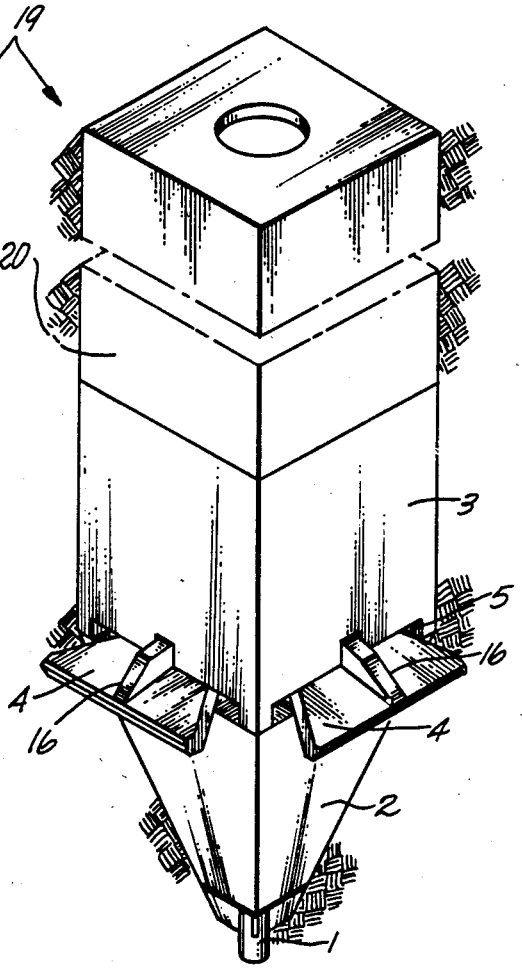
FIG. 2 is a perspective view of the pile of FIG. 1 with the plates moved outwardly.

As shown in the drawings, FIG. 1 and FIG. 2, a column in the form of a pile 19 has a hollow rectangular body portion 20 formed of pre-cast concrete and defining the pile for supporting a building or other structure. The pile may also be formed of steel and may have a circular cross-section or any other suitable cross-sectional shape. Provided at the bottom end of the pile is a toe 3 formed of steel, the upper part of which has a cross-section corresponding to that of the body portion 20 and the lower part 2 of which has the shape of an inverted pyramid for guiding the pile into the soil. In the case where the pile is circular in cross-section, the lower part 2 preferably has the shape of an inverted cone. Provided at the apex of the lower part 2 is a tip 1 for penetrating the soil.

Apertures in the form of slots 5 are provided, preferably at the transition between the upper part and the lower part 2, for positioning and guiding generally transversely oriented steel discs or, as shown in FIG. 7, trapezoidal plates 4, to be described below. The slots have edges 18, 18*a*, 18*b*, and 18*c* formed in the wall of the body portion defining each slot. The slots extend in a direction substantially perpendicular to the direction in which the pile is to be driven. During assembly, transportation and driving of the pile, the plates 4 are retained wholly within the toe 3 by retainer members 6. The retainer members extend generally upwardly across the respective outer ends of the slots 5. The members 6 comprise steel bars or steel plates which at their bottom end are welded to the lower part 2 of the toe and extend upwardly toward the upper part of the toe. During downward movement of the pile, these steel bars 6 are pressed by the surrounding soil which keeps the steel plates 4 in position inside the toe.

Figure 3:
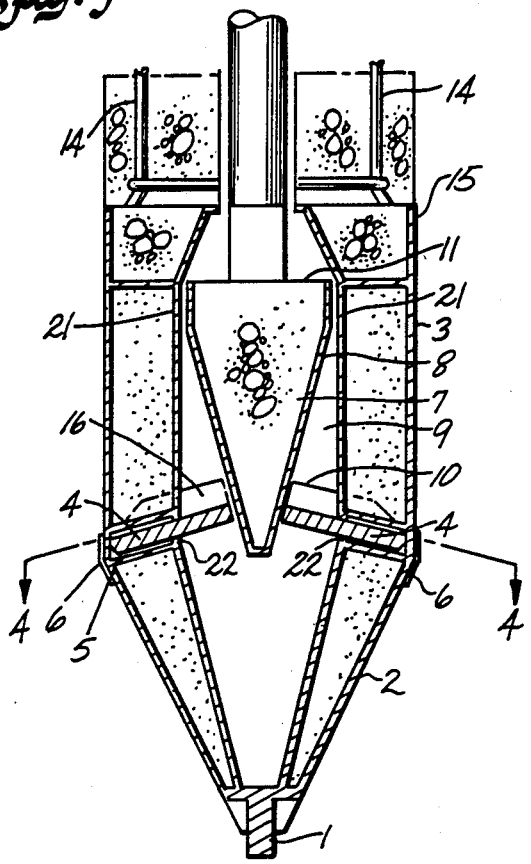
FIG. 3 is a longitudinal section through the toe of the pile of FIG. 1 with the plates retracted, the section being taken along the line III-III of FIG. 4.
Figure 4:
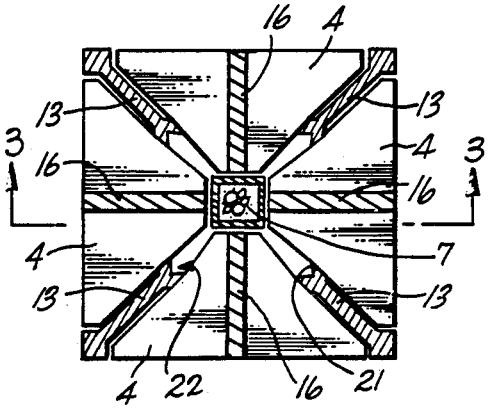
FIG. 4 is a transverse section through the toe of the pile of FIG. 1 taken along the line IV-IV of FIG. 3.

The pile toe 3 is anchored at the body portion 20 of the pile by steel anchors 14 (FIG. 3) which are welded to a steel plate 15 of the pile toe 3. The pile toe 3 is provided with reinforcing ribs 13 (FIG. 4).

The reinforcing ribs 13 provide support between the outer structure of pile toe 3 and an internal frame 21 of the pile toe. The space between the outer structure and the internal frame may be filled with concrete. The internal frame guides and retains an actuator member 7 for actuating the plates outwardly, to be described below. The transverse cross-sectional shape of the internal frame preferably follows, on a longitudinal axis, the transverse cross-sectional shape of the outer structure of pile toe 3. Generally horizontal slots 22 for accommodating the plates 4 are provided, preferably at the transition between upper and lower parts of the internal frame. A vertical slot is formed midway in each respective slot 22 and substantially perpendicular thereto extending upwardly from the slot 22.

The plate 4 preferably is generally trapezoidal-shaped or dove tailed with the long parallel side or outer edge 17 being upwardly tapered so that a bevel is provided on the tope edge (FIG. 7). The trapezoidally-shaped plate is for use preferably with a pyramid-shaped pile toe. The upper surface of each plate (FIG. 7) is provided with an upwardly extending reinforcing rib 16 whose inner end 10 contacts the surface of actuator member 7. As the rib 16 approaches the outer edge 17 of the plate, the upper surface of the rib is beveled downwardly to meet the outer edge 17.

Figure 8:
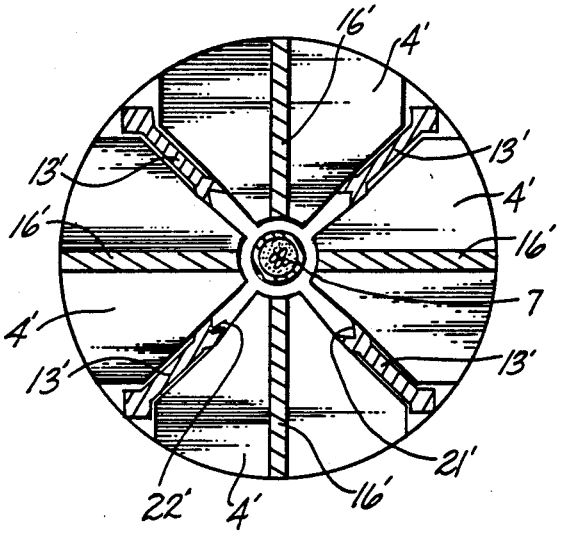
FIG. 8 is a transverse section through the toe of a pile, similar to that of FIG. 4, for an alternate embodiment where the toe of the pile and the actuator all have a conical outer shape.

An actuator member 7 (FIG. 3) is located within the toe 3, interior to the internal frame 21, and is formed from a steel plate 8 and whose interior is filled with concrete. The member 7 is in the form of an inverted pyramid and the sides of the member 7 contact the inner ends of the plates 4. The pyramid-shaped actuator member is provided in the center of the toe, installed with the apex facing downwardly. The actuator member operates as a piston pressed down by an impact mandrel driven from the top of the pile. When the member is driven down by the mandrel, the member forces the plates to move horizontally along the apertures and to penetrate into the soil, thereby increasing the bearing capacity of the pile.

Where the toe is conically shaped, the actuator member is also preferably conically shaped. The pile toe with a conical configuration is shown in FIG. 8, which is a view of a pile toe similar to that of FIG. 4. The shapes of the elements of FIG. 4 have been changed to conform to a pile toe of circular cross-section and are identified with the same reference numerals as used in FIG. 4 but with primes added. The function of the elements is substantially the same as that described with respect to the pile toe of FIG. 4.

The application of the invention will now be described. The pile is driven into the ground until it has penetrated into the firm soil strata. The driving of the pile is terminated and the mandrel is inserted into the pile from its upper end. The mandrel contacts the upper end 11 of the member 7 and is then driven downwardly against the actuator member from the upper end of the mandrel to move the member 7 downwardly. The member 7 acts on the plates 4 to cause them to move outwardly through the apertures 5. During the initial movement of the plates 4, the steel retaining bars or steel plates 6 are deformed outwardly. As shown in FIG. 6, the deformed bars 6 push the plates 4 upwardly so that the latter are pressed against the upper edge 18 of the apertures 5. This also happens as the plates 4 penetrate into the strata surrounding the toe 3 and, due to the tapered surface of each plate 4. The plates 4 remain within the apertures 5 after being pushed outwardly by the member 7. The inner part 9 of the toe 3 is hollow to allow movement of the mandrel. When the plates 4 have been pushed outwardly, the mandrel is removed from the pile and the interior of the body portion of the pile and the inner part 9 of the toe 3 are filled with concrete to strengthen the pile structure. This filling is carried out by passing concrete into the pile from its upper end.

The plates 4, when pushed outwardly, increase the contact area of the pile within the strata into which it has been driven. Thus, the bearing capacity of the pile is increased.

The number of plates 4 is preferably a minimum of two and should be symmetrically disposed.

It will be appreciated that the plates 4 instead of being located within the toe 3 may be located at any other desired location or locations along the pile.

It should be noted that the above are preferred configurations, but others are foreseeable. The described embodiments of the invention are only considered to be preferred and illustrative of the inventive concepts. The scope of the invention is not to be restricted to such embodiments. Various and numerous other arrangements may be devised by one skilled in the art without departing from the spirit and scope of the invention.

What is claimed is:

1. An elongated pile assembly for supporting a structure after the pile assembly is driven into a soil stratum, the assembly comprising:

an elongated pile body having upper and lower ends, a hollow interior and an exterior surface;

a slot extending through the pile body from the hollow interior to the exterior surface of the pile body, said slot comprising an exterior opening having upper and lower edges at the exterior surface of the pile body;

a plate having inner and outer ends positioned within the slot, said plate being moveable from a retracted position wherein the plate does not protrude from the pile body and an extended position wherein the outer end of the plate protrudes from the pile body;

means for moving the plate from its retracted position to its extended position after the pile assembly has been driven into a soil stratum; and at least one deformable retainer bar fixedly attached to the exterior surface of the pile body at a position below the slot, said retainer bar extending upwardly across the exterior opening of the slot to thereby retain the plate within the slot during driving of the pile assembly into a soil stratum, and wherein said retainer bar is deformed when the plate moves from its retracted position to its extended position and wherein in its deformed state, said retainer bar, exerts an upward pressure on the plate to maintain the plate against the upper edge of the exterior opening of the slot and thereby aid in preventing further downward settling of the pile assembly once the plate has been extended.

2. An elongated pile assembly as claimed in claim 1 wherein the means for moving the plate from its retracted position to its extended position comprises an actuator positioned within the hollow interior of the pile body moveable from an upper position to a lower position wherein movement of the actuator from its upper to its lower position causes the plate to move from its retracted position to its extended position; and means for moving the actuator from its upper position to its lower position.

3. An elongated pile assembly as claimed in claim 1 wherein the slot extends in a direction downwardly and outwardly through the pile body.

4. An elongated pile assembly, as claimed in claim 1 wherein the outer end of the plate comprises a tapered edge for urging the plate upwardly against the upper edge of the exterior opening when the plate moves through said stratum from its retracted position to its extended position.

5. An elongated pile assembly as claimed in claim 1 wherein the pile body comprises at least two slots disposed symmetrically about the pile body and wherein a plate having inner and outer ends is positioned within each slot, each plate being movable from a retracted position wherein the plate does not protrude from the pile body and an extended position wherein the outer end of the plate protrudes from the pile body.

6. A pile assembly for supporting a structure after the pile assembly is driven into a soil stratum, the assembly comprising:

a reinforced concrete pile element having a rectangular transverse cross-section and comprising upper and lower ends and a hollow interior which defines a passageway for a mandrel;

a toe mounted on the lower end of the pile element, the toe comprising four side walls defining an upper section having a generally uniform transverse cross-section about the same as the transverse cross-section of the pile element and an inverted pyramidally-shaped bottom section, said toe further comprising a hollow interior and at least two symmetrically positioned slots through the side walls;

a plate positioned within each of said slots, each plate having inner and outer edges, said plates being movable from a retracted position wherein the plates do not protrude from the toe to an extended position wherein at least the outer edge of the plates protrudes from the toe;

an actuator disposed within the interior of the toe movable from an upper position to a lower position wherein movement of the actuator from its upper position to its lower position causes the plates to move from their retracted positions to their extended positions; and at least one deformable metal retainer bar fixedly attached to the exterior surface of the toe at a position below each slot, each retainer bar extending upwardly across the exterior opening of the slot to thereby retain the plate positioned within the slot in tis retracted position during driving of the pile assembly into a soil stratum, and wherein said retainer bar is deformed and exerts an upward pressure on the plate when the plate is caused to move from its retracted position to its extended position and thereby said in preventing further downward settling of the pile assembly once the plates have been extended.

* * * * *